US011547266B1

(12) United States Patent
Regman

(10) Patent No.: US 11,547,266 B1
(45) Date of Patent: Jan. 10, 2023

(54) PORTABLE CLEANING DEVICE WITH SENSORS AND INTERCHANGEABLE CLEANING TOOLS

(71) Applicant: Phillip E Regman, Yreka, CA (US)

(72) Inventor: Phillip E Regman, Yreka, CA (US)

( * ) Notice: Subject to any disclaimer, the term of this patent is extended or adjusted under 35 U.S.C. 154(b) by 295 days.

(21) Appl. No.: 16/903,170

(22) Filed: Jun. 16, 2020

Related U.S. Application Data

(60) Provisional application No. 62/882,935, filed on Aug. 5, 2019.

(51) Int. Cl.

| | |
|---|---|
| ***A47L 13/50*** | (2006.01) |
| ***A47L 13/20*** | (2006.01) |
| ***A47L 13/11*** | (2006.01) |
| ***A47L 13/12*** | (2006.01) |
| ***A46B 5/00*** | (2006.01) |
| ***A46B 15/00*** | (2006.01) |
| ***B25G 1/04*** | (2006.01) |
| ***A47L 11/40*** | (2006.01) |
| ***A47L 13/16*** | (2006.01) |
| ***A47L 11/22*** | (2006.01) |

(52) U.S. Cl.
CPC ..... *A47L 13/50* (2013.01); *A46B 5/005* (2013.01); *A46B 5/0095* (2013.01); *A46B 15/004* (2013.01); *A46B 15/0012* (2013.01); *A46B 15/0038* (2013.01); *A47L 11/22* (2013.01); *A47L 11/4075* (2013.01); *A47L 13/11* (2013.01); *A47L 13/12* (2013.01); *A47L 13/16* (2013.01); *A47L 13/20* (2013.01); *B25G 1/04* (2013.01)

(58) Field of Classification Search
CPC ..... A47L 13/11; A47L 13/12; A47L 13/20; A47L 13/50; A46B 5/005; A46B 5/0095; A46B 15/0012; A46B 15/004; A46B 15/0038; A46B 15/0044; A46B 15/0046; B25G 1/04
USPC ..... 15/105, 145, 146
See application file for complete search history.

(56) References Cited

U.S. PATENT DOCUMENTS

| | | | | |
|---|---|---|---|---|
| 4,866,809 | A * | 9/1989 | Pelletier | A46B 15/0061 206/217 |
| 5,704,087 | A * | 1/1998 | Strub | A46B 15/0008 15/105 |
| 8,918,940 | B2 * | 12/2014 | Gatzemeyer | A46B 15/0008 15/105 |
| 2007/0136964 | A1 * | 6/2007 | Dawley | A61C 17/221 15/22.1 |
| 2008/0016636 | A1 * | 1/2008 | Morris | B25G 3/28 15/145 |

* cited by examiner

*Primary Examiner* — Randall E Chin
(74) *Attorney, Agent, or Firm* — Plager Schack LLP; Mark H. Plager; Kara Verryt

(57) ABSTRACT

A portable cleaning device with interchangeable cleaning tools and an alert system may include an elongate rod having a first end and a second end, a handle attached to the first end of the rod, a cleaning attachment removably engaged with the second end of the rod, a handle grip sensor operatively attached to the handle and a cleaning attachment pressure sensor operatively attached to the cleaning attachment, and an indicator operatively attached to each sensor, the indicator designed to alert a user when the sensor is activated.

8 Claims, 4 Drawing Sheets

PORTABLE CLEANING DEVICE WITH SENSORS AND INTERCHANGEABLE CLEANING TOOLS

RELATED APPLICATION

This application claims priority to provisional patent application U.S. Ser. No. 62/882,935 filed on Aug. 5, 2019, the entire contents of which is herein incorporated by reference.

BACKGROUND

The embodiments described herein relate generally to cleaning devices and, more particularly, to a portable cleaning device with interchangeable cleaning tools and sensors, such as those to alert a user whether or not sufficient pressure is being placed on the surface to be cleaned and whether the user's grip is sufficient.

A key goal of senior citizens is to maintain their independence. As they age however, common tasks can become more difficult as the individual loses mobility and balance. Many household cleaning tools, such as brooms, mops, and related apparatuses are characterized by long handles that extend from a working head. The extended handles allow users to operate features of the implements at ground level while maintaining an upright or substantially upright posture. Although convenient during use, such implements are often difficult to use due to limited mobility or being in a wheelchair. Some tools take this into account by having extendable poles, but they typically only have a single function and do not aid the senior citizen with stabilization during the task. Thus, many senior citizens are at risk of injury or compromised safety when cleaning.

Therefore, what is needed is a multi-purpose cleaning device with interchangeable cleaning tools and a sensor designed to alert a user whether or not (1) the user's grip on the tool is sufficient and (2) sufficient pressure is being placed by the cleaning tool onto the surface to be cleaned.

SUMMARY

Some embodiments of the present disclosure include portable cleaning device with interchangeable cleaning tools and an alert system may include an elongate rod having a first end and a second end, a handle attached to the first end of the rod, a cleaning attachment removably engaged with the second end of the rod, a handle grip sensor operatively attached to the handle and a cleaning attachment pressure sensor operatively attached to the cleaning attachment, and an indicator operatively attached to each sensor, the indicator designed to alert a user when the sensor is activated.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a portable cleaning device and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements and the following examples are presented as illustrative examples only.

By way of example, and referring to FIGS. 1-11, some embodiments of the invention include a portable cleaning device with interchangeable cleaning tools and an alert system to alert a user as to whether grip and pressure are sufficient, the cleaning device comprising an elongate rod having a first end and a second end, wherein the first end of the elongate rod has a handle attached thereto and the second end of the elongate rod has an interchangeable cleaning tool removably attached thereto and wherein at least one sensor is built into the cleaning device. The at least one sensor may comprise a handle grip sensor and/or a cleaning attachment pressure sensor, wherein the handle grip sensor is designed to alert a user if a user's grip on the handle is sufficient and the cleaning attachment pressure sensor is designed to alert the user if pressure placed by the cleaning tool onto the surface to be cleaned is sufficient. In some embodiments, the cleaning device includes both a handle grip sensor and a cleaning attachment pressure sensor.

Figure 1:
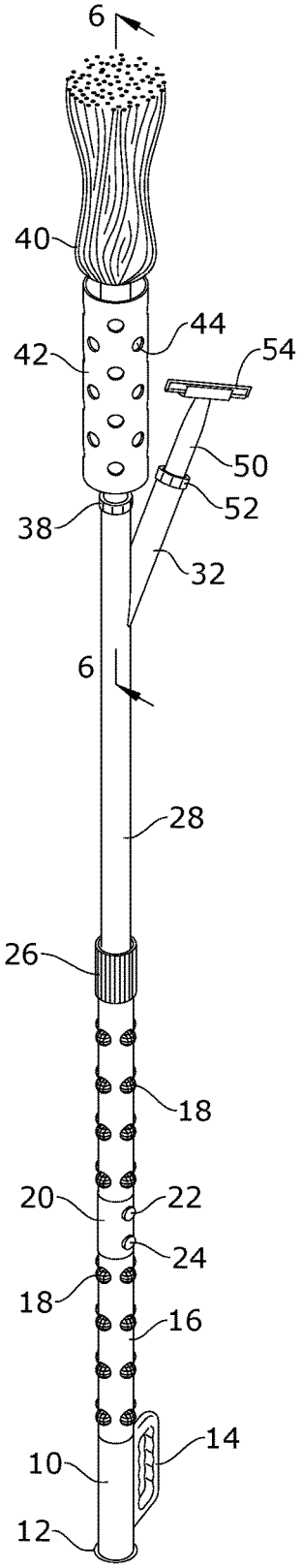
FIG. 1 is a perspective view of one embodiment of the present disclosure.
Figure 2:
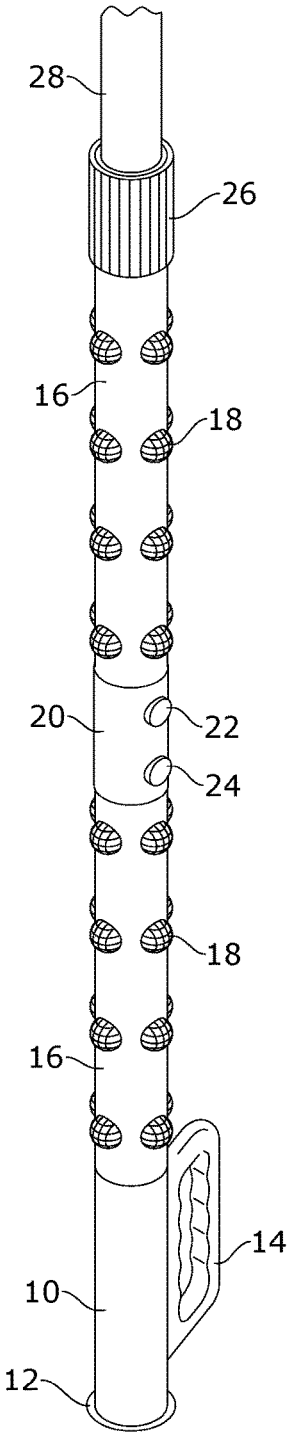
FIG. 2 is a detail perspective view of one embodiment of the present disclosure.
Figure 3:
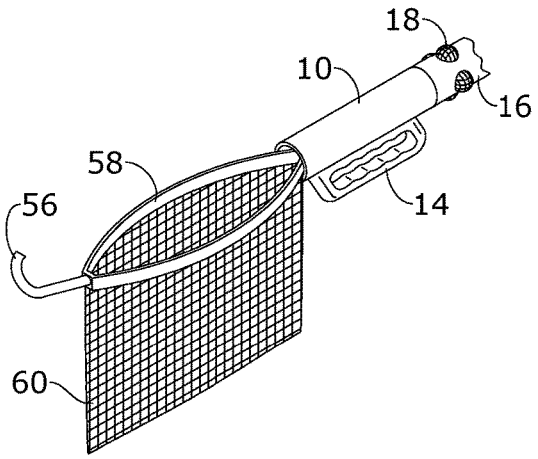
FIG. 3 is a perspective view of one embodiment of the present disclosure.
Figure 4:
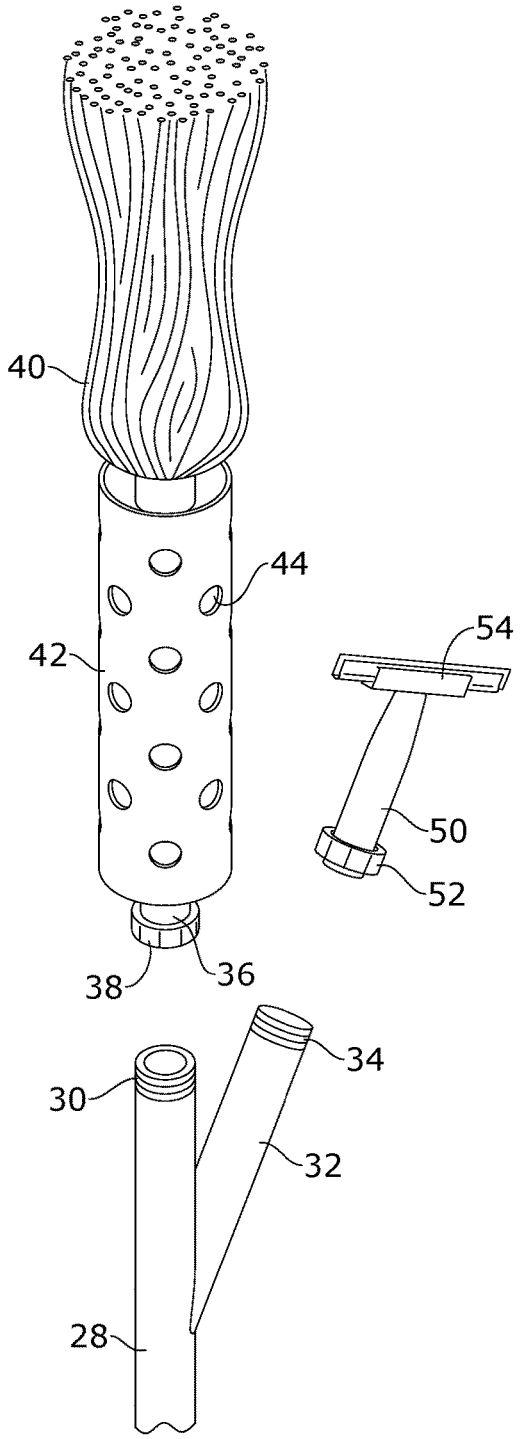
FIG. 4 is a top perspective detail exploded view of one embodiment of the present disclosure.
Figure 5:
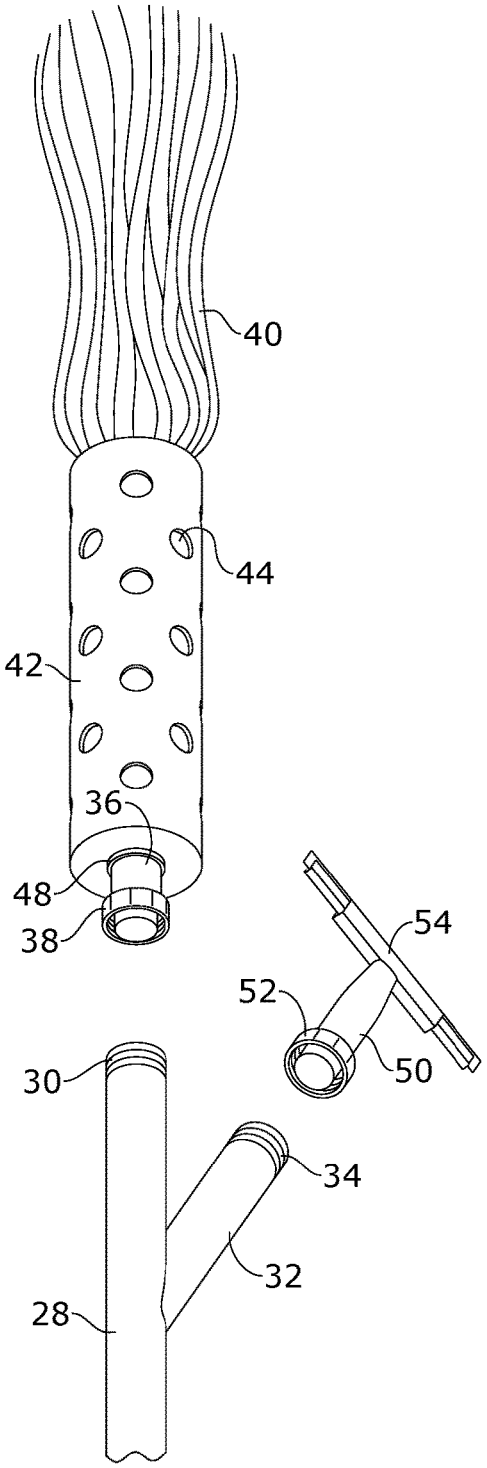
FIG. 5 is a bottom perspective detail exploded view of one embodiment of the present disclosure.
Figure 6:
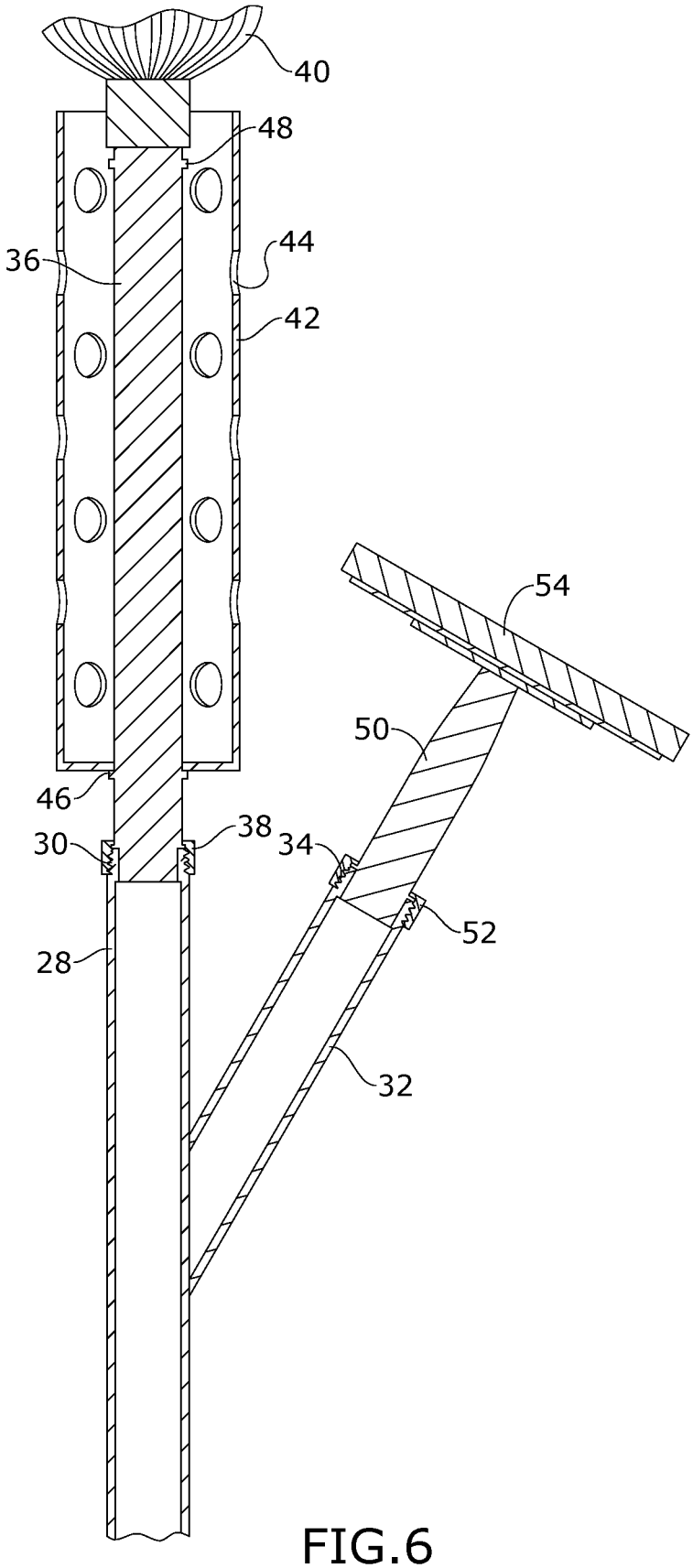
FIG. 6 is a section view of one embodiment of the present disclosure, taken along line 6-6 in FIG. 1.
Figure 7:
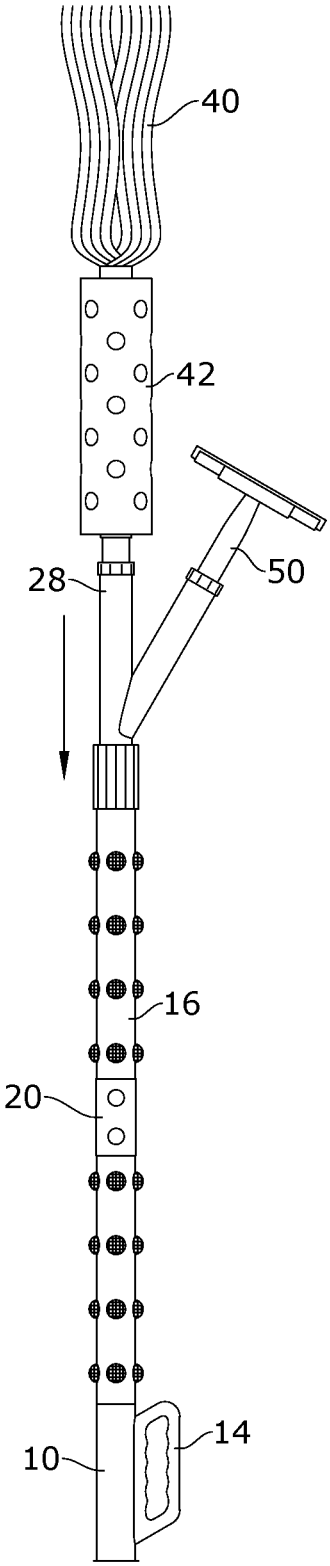
FIG. 7 is a front view of one embodiment of the present disclosure.
Figure 8:
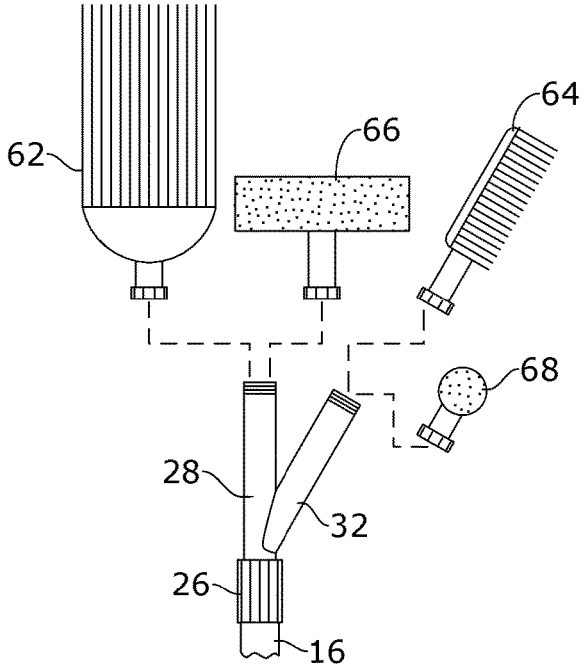
FIG. 8 is a schematic view of one embodiment of the present disclosure.
Figure 10:
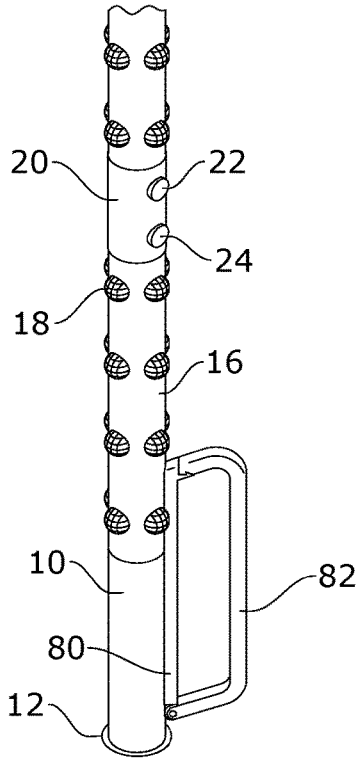
FIG. 10 is a detail perspective view of one embodiment of the present disclosure.
Figure 11:
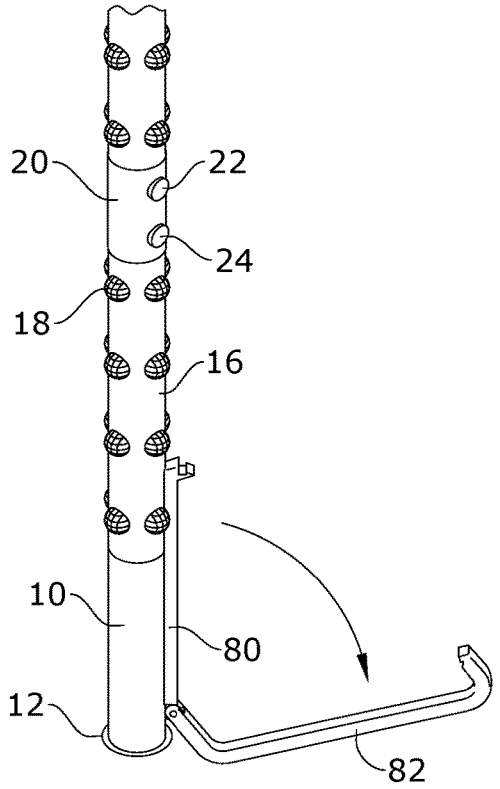
FIG. 11 is a detail perspective view of one embodiment of the present disclosure.

In embodiments, the elongate rod may have an extendible length. For example, as shown in the Figures, the elongate rod may comprise a lower pole 16 and an upper pole 28 designed to telescopically extend from the lower pole 16. A first end of the lower pole 16 may have a base pole 10 attached thereto, wherein a handle 14 may extend from the base pole 10. As shown in FIGS. 1 and 2, the handle 14 may be a stationary handle 14. Alternatively, as shown in FIGS. 10 and 11, the handle may comprise an anchoring portion 80 attached to and running along the length of the base pole 10 and a hinged portion 82, the hinged portion 82 designed to open from a closed/handle configuration (FIG. 10) to an open/hook configuration (FIG. 11). As such, the handle may be multifunctional, providing both a handle for a user to grasp and a hook that may be used to grab other objects. As shown in FIG. 3, a distal end of the base pole 10 may comprise an opening with a removable cap 12 attached thereto. The base pole 10 may be hollow and may be sized to accommodate an additional tool therein, wherein when not in use, the tool may be stored within the base pole 10 and, when in use, the tool may be deployed out of and extend from the base pole 10. As shown in FIG. 3, the additional tool may comprise a net 60 attached to a net frame 58, wherein an end of the net frame 58 may include a hook 56 extending therefrom. In use, the hook 56 may be used to grab and pull an object off of, for example, a high shelf, and the net 60 may be used to catch the object to prevent it from falling to the ground.

As shown in the Figures, the lower pole 16 may have a diameter larger than the upper pole 28. The lower pole 16 may also comprise at least one desiccant chamber, such as a rice chamber, wherein the rice chamber is sized to hold a volume of rice or other moisture wicking or desiccant material. As such, incorporation of a rice chamber may help prevent unwanted moisture build up in the elongate rod and, thus, may help prevent the formation of mold or mildew within the cleaning device of the present disclosure. In some embodiments, the rice chambers may comprise rounded protrusions with outer vent screens 18 extending from an outer surface of the lower pole 16. However, in some embodiments, the rice chambers may be reconfigured, as desired. An end of the lower pole 16 distal from the handle 14 may include a lock 26 attached thereto, wherein the lock 26 may comprise a telescoping lock designed to lock the upper pole 28 in a desired position with respect to the lower pole 16. For example, the lock 26 may comprise any known lock used with telescoping poles, such as a clutch lock, a split collar lock, a cam lock, a shock cord lock, a spring button lock, a spring button A-clutch lock, a snap lock, a set knob lock, a mini-economy lock, a swaging lock, a twisting lock, and the like.

As mentioned above, the upper pole 28 may have a diameter smaller than a diameter of the lower pole 16. An end of the upper pole 28 distal from the lower pole 16 may comprise a cleaning tool removably attached thereto. For example, and as shown in the Figures, the cleaning tool may comprise a mop attachment. Particularly, the mop attachment may comprise a mop pole 36 removably engaged with the distal end of the upper pole 28. A mop head 40 may be attached to an end of the mop pole 36 distal from the upper pole 28. In the case of a squeeze mop, the mop attachment may further comprise a squeeze sleeve 42 slidably attached to the mop pole 36, wherein the mop pole 36 may comprise a lower sleeve stop 46 proximate to the upper pole 28 and an upper sleeve stop 48 proximate to the mop head 40 to prevent the squeeze sleeve 42 from completely sliding off of the mop pole 36. The squeeze sleeve 42 may have a diameter sufficient for accommodating the mop pole 36 and mop head 40 therein. The squeeze sleeve 42 may also comprise at least one, such as a plurality of, sleeve orifices 44 extending therethrough, the orifices 44 positioned to allow for the passage of liquid from a squeezed mop head 40 out of the mop attachment. While a mop head attachment is described above and shown in the Figures, the use of other removably attachments, such as a sponge mop attachment 66, a sponge attachment 68, a broom attachment 62, a brush attachment 64, a squeegee attachment 54, and the like, are also envisioned.

Figure 9:
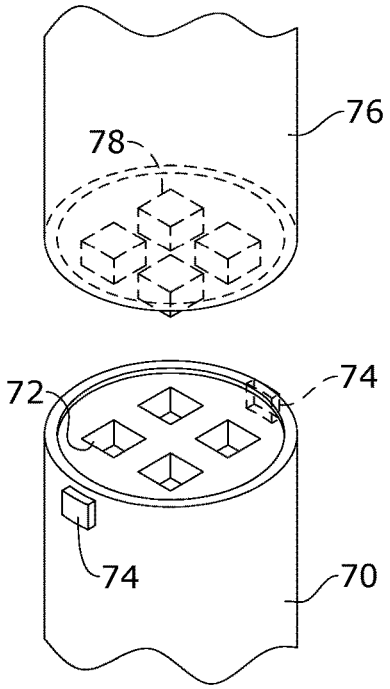
FIG. 9 is a detail perspective view of one embodiment of the present disclosure.

The cleaning tool attachment may removably attach to the upper pole 28. For example, as shown in FIGS. 4-7, a distal end of the upper pole 28 may comprise attachment threads 30. The end of the cleaning tool attachment pole designed to engage with the attachment threads 30 may comprise a threaded slip nut 38. Alternatively, as shown in FIG. 9, an alternate upper pole 70 may comprise a distal end with a plurality of attachment slots 72 extending therein, wherein the attachment slots 72 are sized and positioned to accommodate compatible attachment plugs 78 extending outward from the end of the alternate attachment pole 76 on the cleaning attachment. In such cases, the upper pole 70 may also include at least one release button 74 that, when depressed, forces the plugs 78 to disengage from the attachment slots 72.

In embodiments, and as shown in the Figures, the upper pole 28 may further comprise an angled accessory pole 32 extending outward therefrom. The angled accessory pole 32 may be positioned proximate to the distal end of the upper pole 28, such that at least a portion of the upper pole 28 may still be capable of collapsing into the lower pole 16. The accessory pole 32 may be designed to removably engage with cleaning accessories or cleaning attachments. The end of the accessory pole 32 designed to removably engage with the cleaning accessory or cleaning attachment may have a structure similar to the end of the upper pole 28 designed to engage with the cleaning attachment. For example, the angled accessory pole 32 may comprise accessory threads 34 designed to engage with an accessory slip nut 52. In the case of, for example, a squeegee attachment, the squeegee 54 may be attached to a first end of a squeegee pole 50, wherein the accessory slip nut 52 may be attached to a second end of the squeegee pole 50. Alternatively, the accessory pole 32 may include an attachment slot/plug system as described above with respect to an alternate upper pole attachment mechanism. In fact, with both the upper pole 28 and the accessory pole 32, a suitable fastening mechanism to removably engage the attachment or accessory with the pole 28/32 is envisioned.

As mentioned above, the cleaning device of the present disclosure may further comprise at least one sensor positioned therein. These sensors may be especially beneficial to the elderly, handicapped, or otherwise impaired population and may help prevent unintentional falls or injuries due to improper cleaning techniques. For example, a first sensor may be built into the handle and may alert a user if his or her grip is sufficient for properly holding the cleaning device. Specifically, the first sensor may comprise a pressure sensor built into the handle, wherein the sensor is attached via a first wire to a positive side of a battery, a second wire connects the battery to a first indicator, and a third wire connects the sensor to the negative side of the battery, wherein when a user grips the handle with a firm enough grip, a circuit is completed between the battery and the first indicator, causing the first indicator to emit an alert. A second sensor may be built into the upper pole 28 proximate to the connection with the cleaning attachment, wherein the second sensor may alert a user whether or not the cleaning attachment is contacting and placing pressure on the surface to be cleaned. Particularly, the second sensor may comprise a momentary contact switch wherein, when sufficient pressure is placed on the surface to the cleaned, the momentary contact switch is activated, completing a circuit between the battery and a second indicator to produce an alert. For example, as shown in the Figures, the first indicator may comprise a first indicator light 24 and the second indicator may be a second indicator light 22, wherein the lights illuminate when the proper grip and pressure are used, respectively. However, the indicators are not limited to lights. Rather, the indicator may be a device designed to produce any suitable alert to a user, such as a sound, vibration, or the like. As shown in the Figures, the indicators and the sensor battery chamber 20 may be built into the lower pole 16; however, the positioning of the indicators and battery chamber is not particularly limited.

The device of the present disclosure may be made of any desired or suitable materials. For example, the rod may comprise plastic, metal, carbon fiber, or the like. The handle may or may not comprise a gripping material. The attachments may be made of any suitable material and, in some embodiments, are made at least partially of machine-washable materials.

To use the device of the present disclosure, a user would attach the desired cleaning attachment and, optionally, the desired cleaning accessory to the upper pole 28 and accessory pole 32, respectively. The user may then grip the handle, ensuring that the indicator has produced the alert for a sufficient grip. The user may then use the cleaning attachment to clean the desired surface, wherein the second indicator will produce an alert once sufficient pressure is placed on the cleaning surface by the cleaning attachment and accessory.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A portable cleaning device with interchangeable cleaning tools and an alert system, the cleaning device comprising:

an elongate rod having a first end and a second end;

a handle attached to the first end of the rod;

a cleaning attachment removably engaged with the second end of the rod;

at least one sensor built into the cleaning device, the at least one sensor selected from the group consisting of a handle grip sensor operatively attached to the handle and a cleaning attachment pressure sensor operatively attached to the cleaning attachment; and an indicator operatively attached to the at least one sensor, the indicator designed to alert a user when the sensor is activated, wherein:

the elongate rod comprises a lower pole telescopically attached to an upper pole;

the lower pole is attached to the handle;

the upper pole is removably engaged with cleaning attachment;

the upper pole includes an angled accessory pole extending therefrom at a position proximate to a distal end thereof; and the angled accessory pole is designed to removably engage with a cleaning accessory attachment.

2. The cleaning device of claim 1, wherein the cleaning device includes both the handle grip sensor and the cleaning attachment pressure sensor.

3. The cleaning device of claim 1, further comprising at least one desiccant chamber built into the lower pole, wherein the desiccant chamber is sized to accommodate a volume of a desiccant material.

4. The cleaning device of claim 1, wherein:

the distal end of the upper pole comprises attachment threads designed to engage with a slip nut on the cleaning attachment; and a distal end of the accessory pole comprises accessory threads designed to engage with a slip nut on the cleaning accessory attachment.

5. The cleaning device of claim 1, wherein:

the distal end of the upper pole comprises attachment slots designed to removably engage with attachment plugs extending from the cleaning attachment.

6. The cleaning device of claim 1, wherein the cleaning attachment is selected from the group consisting of a squeeze mop attachment, a squeegee attachment, a sponge mop attachment, a brush attachment, a broom attachment, and a sponge attachment.

7. The cleaning device of claim 1, wherein the indicator is selected from the group consisting of a light, a sound device, and a vibration device.

8. A portable cleaning device with interchangeable cleaning tools and an alert system, the cleaning device comprising:

an elongate rod having a first end and a second end;

a handle attached to the first end of the rod;

a cleaning attachment removably engaged with the second end of the rod;

at least one sensor built into the cleaning device, the at least one sensor selected from the group consisting of a handle grip sensor operatively attached to the handle and a cleaning attachment pressure sensor operatively attached to the cleaning attachment; and an indicator operatively attached to the at least one sensor, the indicator designed to alert a user when the sensor is activated, wherein:

the elongate rod comprises a lower pole telescopically attached to an upper pole;

the lower pole is attached to the handle;

the upper pole is removably engaged with the cleaning attachment; and the cleaning device further comprises at least one desiccant chamber built into the lower pole, wherein the desiccant chamber is sized to accommodate a volume of a desiccant material.

* * * * *